US006019308A

United States Patent [19]

Huang

[11] Patent Number: 6,019,308

[45] Date of Patent: Feb. 1, 2000

[54] DEVICE FOR DISPENSING PLASTIC FILM ROLL

[76] Inventor: Harrison Huang, No. 23, Lin T'So Rd., Shengkang, Taichung Hsien, Taiwan

[21] Appl. No.: 09/161,457

[22] Filed: Sep. 28, 1998

[51] Int. Cl.[7] ..... B65H 75/02

[52] U.S. Cl. ..... 242/588.2

[58] Field of Search ..... 242/588.1, 588.2, 242/588, 405, 405.3

[56] References Cited

U.S. PATENT DOCUMENTS

| | | | |
|---|---|---|---|
| 4,582,273 | 4/1986 | Saraisky | 242/588.1 |
| 4,817,762 | 4/1989 | Powell | 242/588.2 |
| 4,834,312 | 5/1989 | Riemenschneider | 242/588.2 |
| 5,203,517 | 4/1993 | Parry et al. | 242/588.2 |

*Primary Examiner*—John M. Jillions
*Attorney, Agent, or Firm*—Browdy and Neimark

[57] ABSTRACT

A plastic film roll dispenser is composed of a holding sleeve and a rotating sleeve. The holding sleeve is provided at one end thereof with a flat portion and at other end thereof with a plurality of retaining members. The flat portion has an eccentric grip portion. The rotating sleeve is provided at one end thereof with an urging ring and in the outer circumferential surface thereof with a plurality of longitudinally-oriented ribs. The rotating sleeve is further provided with a round through hole having in the inner wall thereof a retaining surface engageable with the retaining members of the holding sleeve. The rotating sleeve is rotatably fitted over the holding sleeve.

7 Claims, 4 Drawing Sheets

DEVICE FOR DISPENSING PLASTIC FILM ROLL

FIELD OF THE INVENTION

The present invention relates generally to a device for dispensing a plastic film roll, and more particularly to a plastic film roll dispenser which is simple in construction and easy to use.

BACKGROUND OF THE INVENTION

As shown in FIG. 1, a plastic film roll dispenser disclosed in the U.S. Pat. No. 4,582,273 is composed of two sleeves which are fitted with both ends of a reel on which the plastic film is wound. In order to secure the two sleeves, an elastic retainer is provided between the two sleeves. Such a prior art dispenser as described above is complicated in construction, and the elastic retainer is not effective. Further it lacks a shield to prevent the fingers of an operator from being injured b: the plastic film roll in motion.

SUMMARY OF THE INVENTION

The primary objective of the present invention is therefore to provide a plastic film roll dispenser which is simple in construction, cost-effective, and easy to use.

In keeping with the principle of the present invention, the foregoing objective of the present invention is attained by the plastic film roll dispenser consisting of a holding sleeve and a rotating sleeve. The holding sleeve is provided with a grip portion of an eccentric design to facilitate the dispensing of the plastic film roll.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
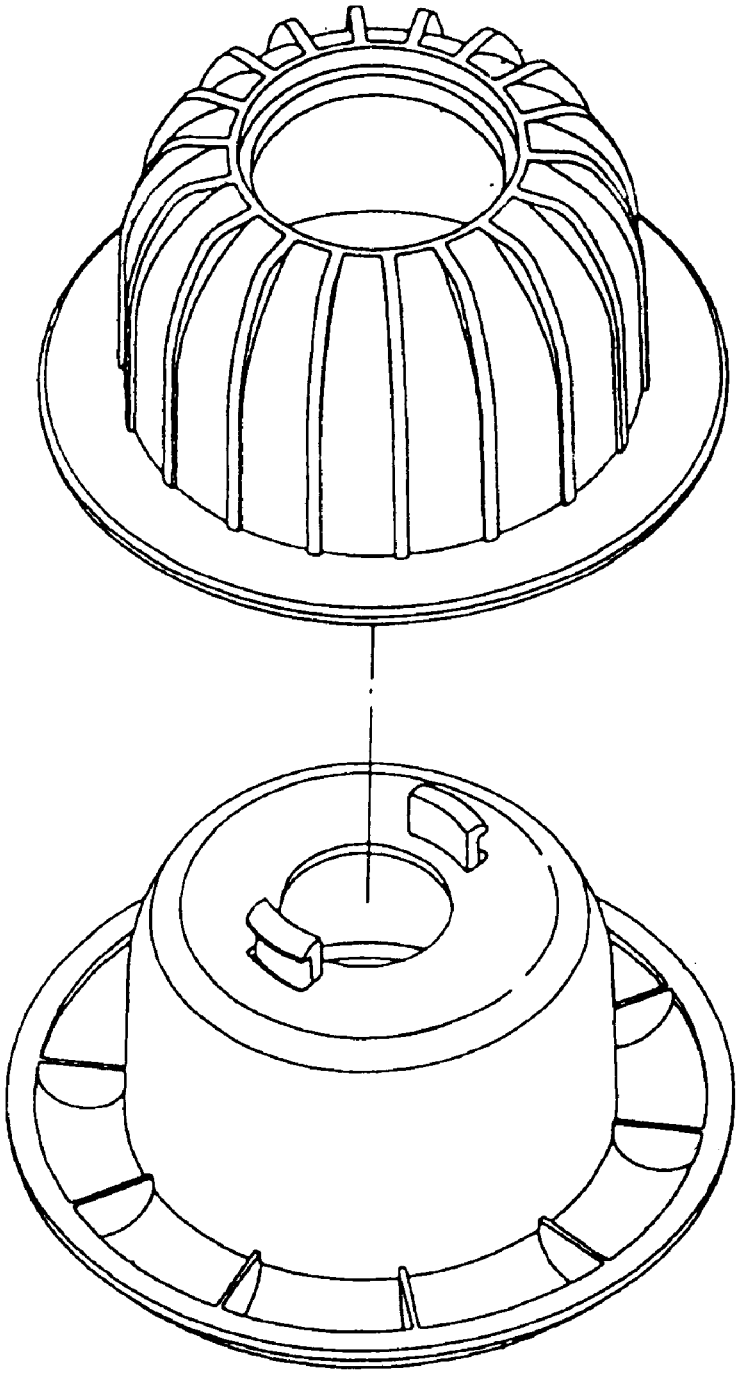
FIG. 1 PRIOR ART
FIG. 1 shows a schematic view of a plastic film roll dispenser of the prior art.
Figure 2:
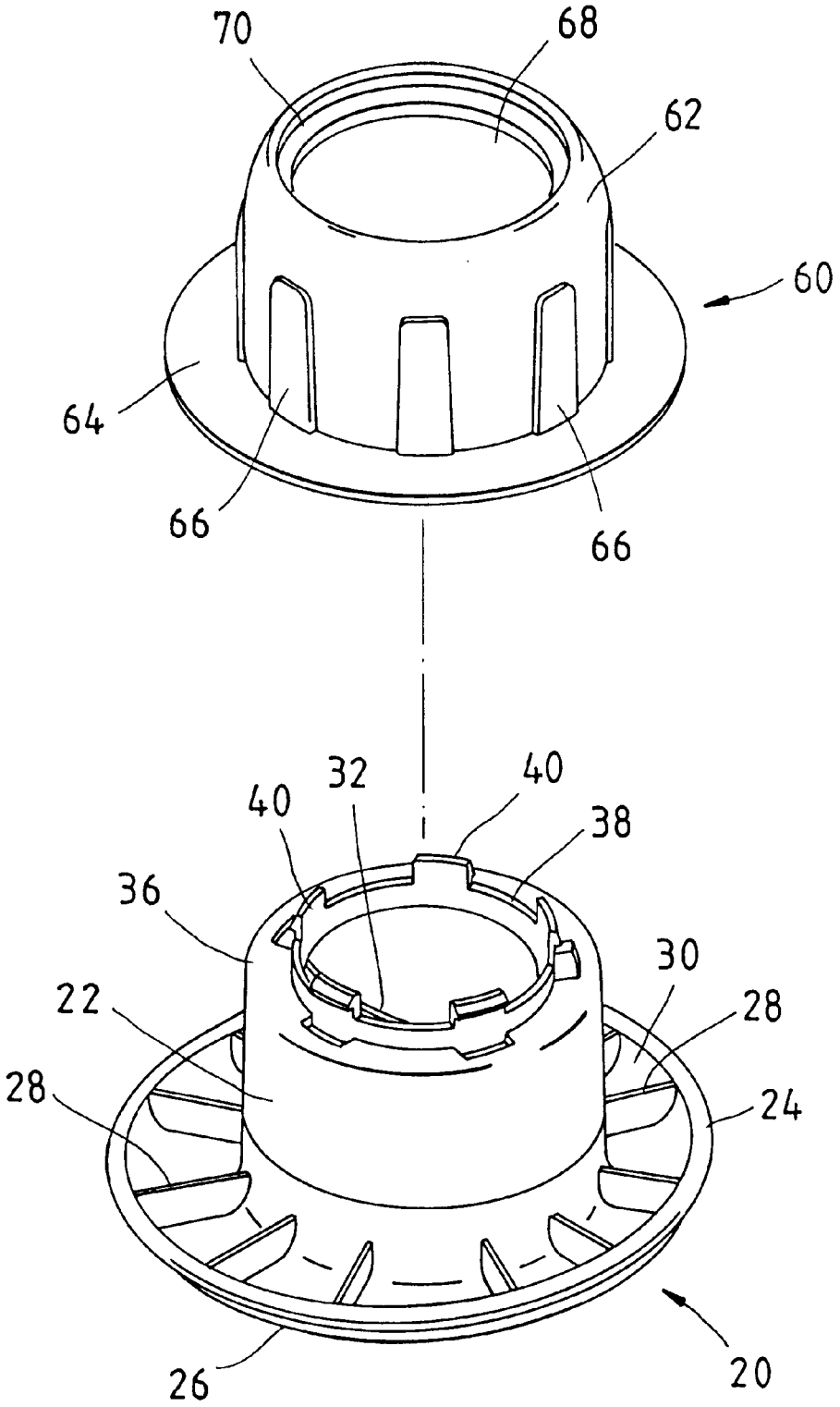
FIG. 2 shows an exploded view of a plastic film roll dispenser of the present invention.
Figure 3:
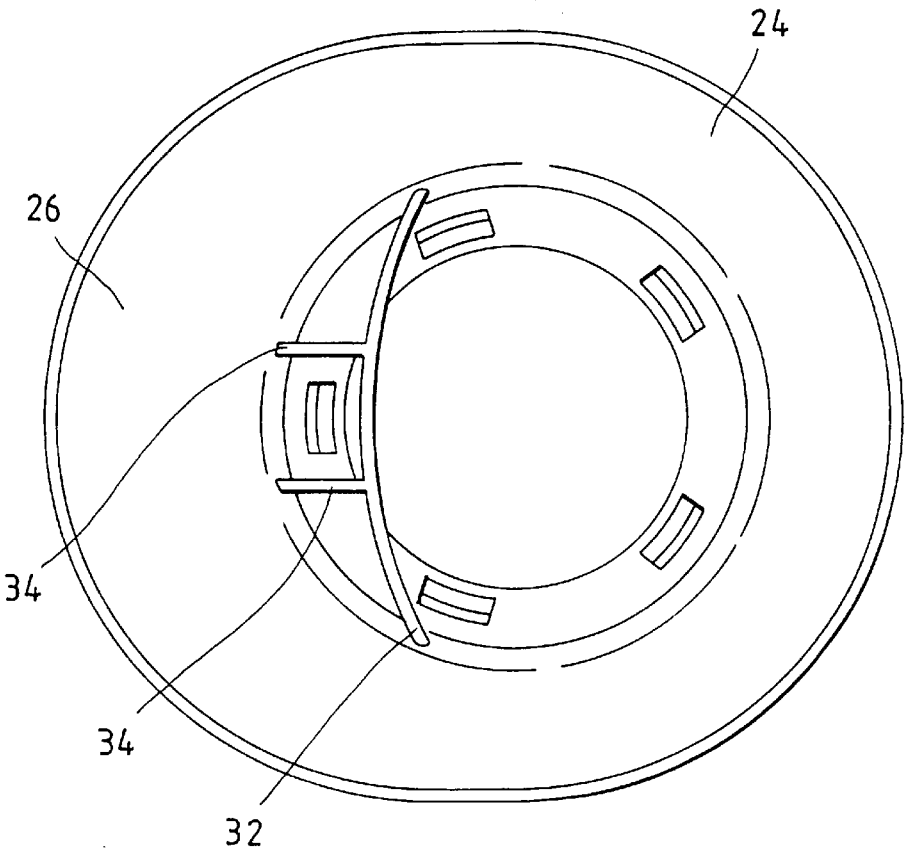
FIG. 3 shows a bottom view of the present invention.
Figure 4:
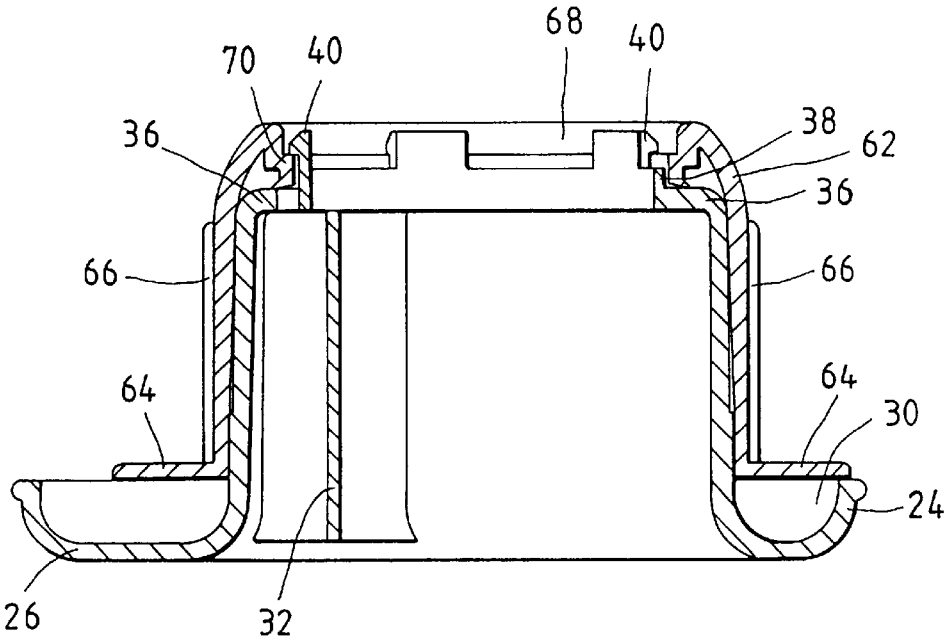
FIG. 4 shows a sectional view of a portion taken along the direction indicated by a line 4—4 as shown in FIG. 2.

As shown in FIGS. 2–4, a plastic film roll dispenser embodied in the present invention is composed of a holding sleeve 20 and a rotating sleeve 60.

The holding sleeve 20 has a cylindrical body 22 and an arcuate flat portion 24 extending outwards from one end of the cylindrical body 22 such that the flat portion 24 is expanded to form a grip portion 26 having a circle center which is not aligned with the circle center of the cylindrical body 22. The grip portion 26 of the eccentric design can be held easily with a hand. The flat portion 24 has an inner recessed ring 30 which is provided with a plurality of ribs 28 which are arranged in a radial manner from the axis (the circle center) of the cylindrical body 22. As shown if FIGS. 2 and 4, the ribs 28 in the grip portion 26 are longer then those in the remaining portion of flat portion 24. The cylindrical body 22 is provided in the interior thereof with a press plate 32 located in the side in which the grip portion 26 is located. Located between the press plate 32 and the inner circumferential surface of the cylindrical body 22 are a plurality of longitudinally-oriented ribs 34. The cylindrical body 22 is further provided with a shoulder 36 on which a shaft ring 38 is located. The shaft ring 38 is provided with a plurality of retaining members 40.

The rotating sleeve 60 has a cylindrical body 62 having an inner diameter which is greater than the outer diameter of the cylindrical body 22 of the holding sleeve 20. The holding sleeve 20 is fitted into the rotating sleeve 60 so that flat portion 24 abuts urging ring 64 on cylindrical body 62. urging ring 64 has an outer diameter which is smaller than the outer diameter of the flat portion 24. The cylindrical body 62 is provided in the outer circumferential surface thereof with a plurality of ribs 66, and is further provided at other end thereof with a round through hole 68 having an inner diameter greater than the outer diameter of the shaft ring 38. The round through hole 68 is provided in the inner wall thereof with a circular retaining surface 70.

Figure 5:
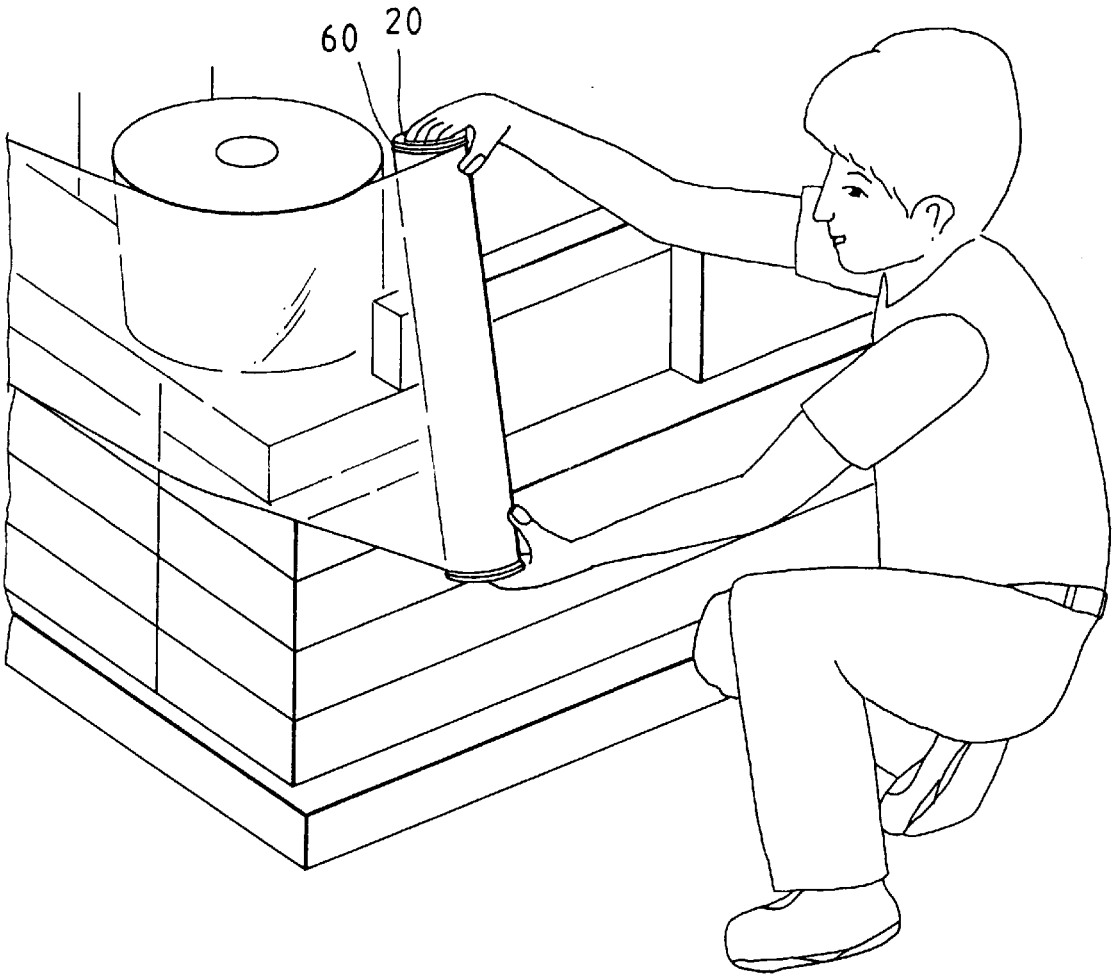
FIG. 5 shows a schematic view of the present invention at work.

As shown in FIGS. 4 and 5, the urging ring 64 of the rotating sleeve 60 is engaged with the cylindrical body 22 of the holding sleeve 20 such that the retaining members 40 are retained by the retaining surface 70 via the round through hole 68. The both ends of a plastic film reel are engaged with two dispensers. The press plates and the grip portions are held by fingers of both hands of an operator. In dispensing the plastic film, the rotating sleeve 60 is turned such that both hands of the operator are protected by the urging rings 64 and the flat portions 24. The grip portion 26 can be easily gripped to facilitate the dispensing of the plastic film.

What is claimed is:

1. A plastic film roll dispenser comprising:

a holding sleeve having a cylindrical body which is provided at a first end thereof with a flat portion and at a second end thereof with a plurality of retaining members, said flat portion provided with a grip portion;

a rotating sleeve having a cylindrical body into which said cylindrical body of said holding sleeve is fitted such that said rotating sleeve can be turned in relation to said holding sleeve;

wherein said holding sleeve has a press plate located in said cylindrical body of said holding sleeve on a side at which said grip portion is located; and wherein said holding sleeve is provided with a plurality of ribs located between said press plate and an inner wall of said cylindrical body.

2. The dispenser as defined in claim 1, wherein said rotating sleeve is provided with a round through hole having in an inner wall thereof a circular retaining surface; and wherein said retaining members of said holding sleeve are retained by said retaining surface via said round through hole.

3. The dispenser as defined in claim 1, wherein said cylindrical body of said rotating sleeve is provided in an outer circumferential surface thereof with a plurality of ribs extending in the direction of a longitudinal axis thereof.

4. A plastic film roll dispenser comprising:

a holding sleeve having a cylindrical body which is provided at a first end thereof with a flat portion and a second end thereof with a plurality of retaining members;

a rotating sleeve having a cylindrical body into which said cylindrical body of said holding sleeve is fitted so that an urging ring of said rotating sleeve abuts said flat portion;

a projecting side of said flat portion being spaced apart from said urging ring of said rotating sleeve to provide a grip portion on said flat portion of said holding sleeve;

wherein a user can hold said film roll by said grip portion while said rotating sleeve turns in relation to said holding sleeve.

5. The dispenser as defined in claim 4, wherein said rotating sleeve is provided with a round through hole having in an inner wall thereof a circular retaining surface; and wherein said retaining members of said holding sleeve are retained by said retaining surface via said round through hole.

6. The dispenser as defined in claim 4, wherein said holding sleeve has a press plate located in said cylindrical body of said holding sleeve on a side at which said grip portion is located; and wherein said holding sleeve is provided with a plurality of ribs located between said press plate and an inner wall of said cylindrical body.

7. The dispenser as defined in claim 4, wherein said cylindrical body of said rotating sleeve is provided in an outer circumferential surface thereof with a plurality of ribs extending in the direction of a longitudinal axis thereof.

* * * * *